US009636839B2

(12) United States Patent
Smithwick, Jr.

(10) Patent No.: US 9,636,839 B2
(45) Date of Patent: May 2, 2017

(54) ROTARY CUTTING DIE FOR CUTTING CORRUGATED BOARD HAVING AN INSERT FOR SUPPORTING A PRODUCT EJECTOR ADJACENT A CUTTING OR SCORING RULE

(71) Applicant: Container Graphics Corporation, Cary, NC (US)

(72) Inventor: James M. Smithwick, Jr., New Bern, NC (US)

(73) Assignee: Container Graphics Corporation, Cary, NC (US)

( * ) Notice: Subject to any disclaimer, the term of this patent is extended or adjusted under 35 U.S.C. 154(b) by 0 days.

(21) Appl. No.: 14/813,419

(22) Filed: Jul. 30, 2015

(65) Prior Publication Data

US 2017/0028581 A1 Feb. 2, 2017

(51) Int. Cl.

| | |
|---|---|
| ***B26D 7/06*** | (2006.01) |
| ***B26F 1/38*** | (2006.01) |
| ***B26D 7/18*** | (2006.01) |
| ***B26F 1/44*** | (2006.01) |

(52) U.S. Cl.

CPC ..... *B26F 1/384* (2013.01); *B26D 7/1818* (2013.01); *B26F 1/44* (2013.01)

(58) Field of Classification Search

CPC ..... B26F 1/384; B26F 1/44; B26D 7/1818; Y10T 83/9437

USPC ..... 83/115, 653, 373

See application file for complete search history.

(56) References Cited

U.S. PATENT DOCUMENTS

| | | | | |
|---|---|---|---|---|
| 9,011,132 | B1 * | 4/2015 | Wei | B29C 37/02 425/290 |
| 9,067,335 | B2 * | 6/2015 | Dulaney | B26F 1/384 |
| 2011/0265620 | A1 * | 11/2011 | Kicinski | B26D 7/1818 83/27 |
| 2012/0111165 | A1 * | 5/2012 | Closmann | B26D 7/1854 83/100 |

* cited by examiner

*Primary Examiner* — Omar Flores Sanchez

(74) *Attorney, Agent, or Firm* — Coats and Bennett, PLLC

(57) ABSTRACT

A rotary cutting die for cutting corrugated board includes a die board having an opening therein. Extending through the opening is a cutting or scoring rule. Secured within the opening is one or more inserts that support one or more product ejectors for assisting in separating a die cut product from the cutting die.

21 Claims, 7 Drawing Sheets

ROTARY CUTTING DIE FOR CUTTING CORRUGATED BOARD HAVING AN INSERT FOR SUPPORTING A PRODUCT EJECTOR ADJACENT A CUTTING OR SCORING RULE

FIELD OF THE INVENTION

The present invention relates to rotary cutting dies designed to cut and score corrugated board that is used in making corrugated board boxes.

BACKGROUND OF THE INVENTION

Rotary cutting dies are used to cut and score sheets of corrugated board to produce a die cut product that can be manipulated into boxes. Rotary cutting dies typically include a curved die board that is configured to mount on a die cylinder. When used, the die cylinder and die board are mounted adjacent an anvil and a nip is defined between the cylinder and the anvil. Sheets of corrugated board are fed into and through the nip and, in the process, the sheet of corrugated board is cut and scored to form the die cut product. Die boards commonly include product and scrap cutting blades, scoring rules, trim and scrap strippers and product ejectors for separating the die cut product from the cutting die.

A common problem with rotary cutting dies that operate on corrugated board is controlling the pressure exerted against the corrugated board by the product ejectors. If the pressure is too great, the die cut product is damaged. That is, if the pressure is too great, the flutes are crushed. This makes the resulting boxes weaker and hence the boxes possess less stacking strength and the crushed flutes have a negative impact on the appearance of the product.

On the other hand, if the pressure exerted by the product ejectors is too low, then this will impact the separation of the die cut product from the cutting die during the die cutting operation. That is, if the pressure is insufficient to dislodge or remove the cut die product from the cutting die, it follows that the product will continue with the cutting die and the die cutting operation will be seriously impacted.

There have been attempts at controlling the pressure exerted by the product ejectors. For example, there have been attempts at using softer elastomer ejectors. This has met with only limited success. Even so, the softer elastomer product ejectors can be expensive and that alone has discouraged the adoption of some softer product ejector elastomers. Another attempt at solving this problem has been to use a water jet cutter to cut openings in the product ejectors. This has not proven completely successful. There are still problems with the pressure being too great and resulting in damage to the die cut product. In addition, the use of laser cut product ejectors adds significant cost to cutting dies.

In some cases, product ejectors are required adjacent a cutting or scoring rule. This limits the options for dealing with this problem because, in conventional designs, the die board itself supports the scoring or cutting rule. Here, care must be taken not to incorporate a product ejector design that compromises or impairs the integrity of the die board adjacent areas that support the cutting or scoring rules.

Therefore, there has been and continues to be a need for an efficient and effective product ejector design that can be incorporated into a die board adjacent a scoring or cutting rule that does not compromise or impair the integrity of the die board in locations where the die board supports the cutting or scoring rule.

SUMMARY OF THE INVENTION

A rotary cutting die for cutting corrugated board includes a die board having an opening formed therein. A rule support structure, such as one or more ribs, is anchored to the die board and spans the opening. A scoring or cutting rule is supported by the rib. The scoring or cutting rule extends over at least a portion of the opening in the die board. At least one insert is secured to the die board and disposed in the opening of the die board. One or more product ejectors are secured to the insert in a position adjacent the scoring or cutting rule. The product ejector extends past the outer edge of the scoring or cutting rule when there is no load on the product ejector.

In one embodiment, there is provided a single insert that is disposed in the opening in the die board and wherein the single insert supports a plurality of product ejectors that are disposed on both sides of the scoring or cutting rule. In another embodiment, a plurality of inserts is secured in the opening in the die board and each insert supports at least one product ejector.

Other objects and advantages of the present invention will become apparent and obvious from a study of the following description and the accompanying drawings which are merely illustrative of such invention.

DESCRIPTION OF EXEMPLARY EMBODIMENTS

With further reference to the drawings, a rotary cutting die apparatus is shown therein and indicated generally by the numeral 30. As is appreciated by those skilled in the art, the rotary cutting die apparatus 30 is designed to receive sheets of corrugated board CB and to die cut the sheets of corrugated board to produce a die cut product. Further, the rotary cutting die apparatus 30 is designed to cut, score and, in most cases, remove scrap from areas of the product board. In the end, the rotary cutting die apparatus is designed to cut and condition the corrugated board CB such that the die cut product can be easily manipulated into a box configuration.

Figure 1:
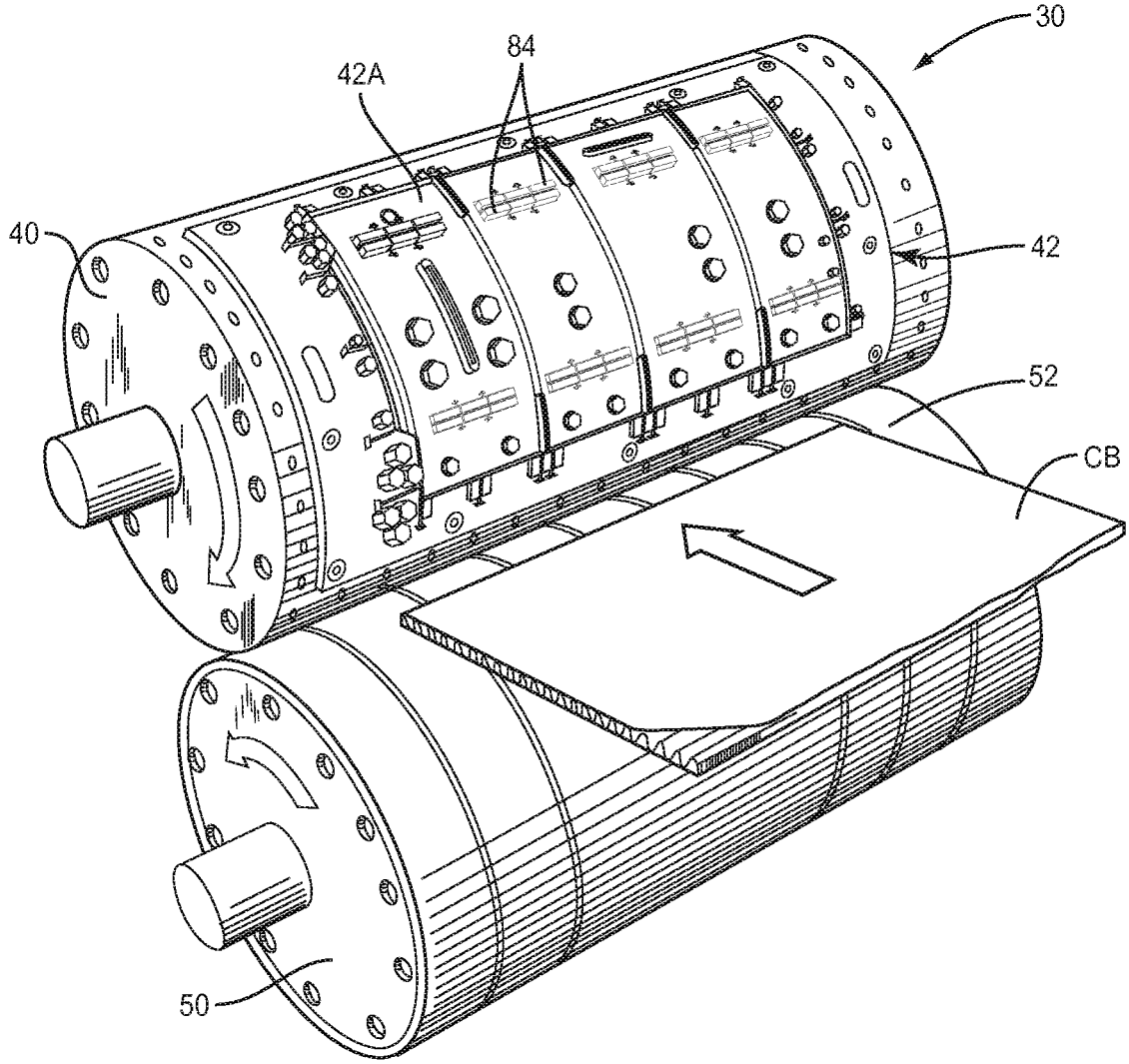
FIG. 1 is a perspective view of a rotary die cutting machine including a rotary cutting die mounted on a die cylinder and an anvil disposed adjacent of the cylinder.

With particular reference to FIG. 1, the rotary cutting die apparatus 30 includes a die board cylinder 40 and an anvil cylinder 50. As will be appreciated from subsequent portions of the disclosure, the die board cylinder 40 is designed to receive and hold a curved die board 42. Die board cylinder 40 and the die board 42 are disposed with respect to the anvil 50 such that the nip is defined between the cylinder and the anvil. As sheets of corrugated board CB are fed through the nip, the corrugated board engages the die board 42 which trims, cuts and scores the corrugated board. Anvil cylinder 50 is typically surrounded by a sheath 52 which is a relatively durable material such as urethane, which provides a backing surface against which a cut can be made without damaging various components carried by the die board 42. As such, the anvil cylinder 50 rotates in a manner that is generally synchronous with the adjacent die board cylinder 40 during normal operations.

Die board 42 is typically constructed of laminated plywood. Die boards, such as that illustrated in FIG. 1, typically include a combination of cutting rules, scoring rules, resilient scrap strippers and product ejectors. Details of the die board 42 are not dealt with herein because die boards for operating on corrugated board are well known and appreciated by those skilled in the art and conventional elements of such die boards are not per se material to the die board design discussed herein.

The design of the die board 42 shown in FIGS. 1-6 focuses on providing a die board design that enables efficient product ejectors to be disposed adjacent a cutting or scoring rule. As used herein, the term "scoring or cutting rule" or "cutting or scoring rule" includes rules or blades that score and cut corrugated board, as well as rules or blades that perforate corrugated board.

Figure 2A:
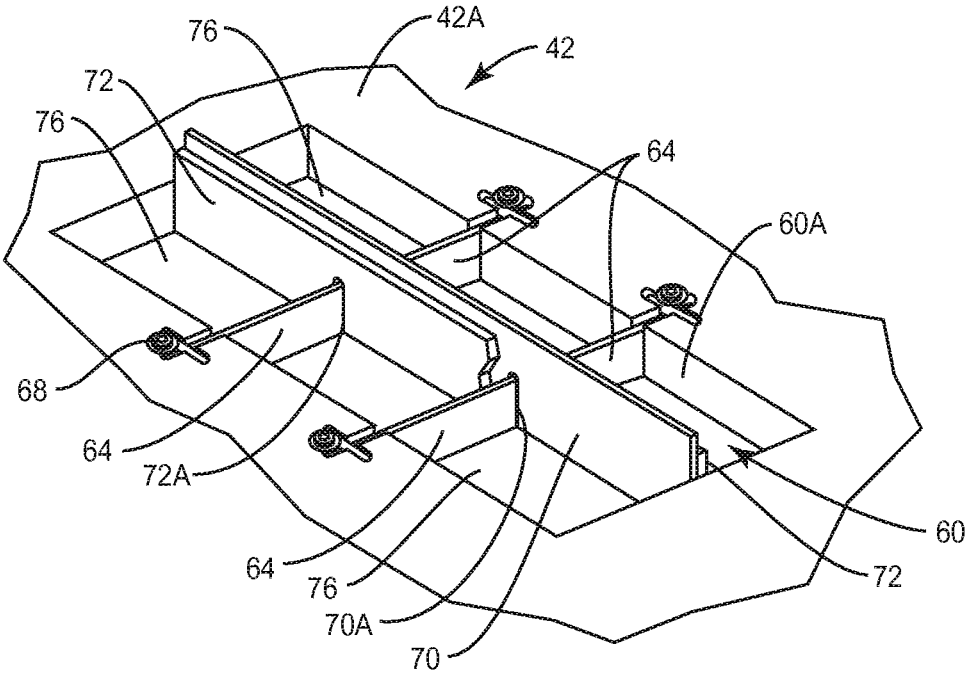
FIG. 2A is a fragmentary perspective view of a die board having an opening formed therein and showing a plurality of ribs supporting a scoring or cutting rule that spans the opening in the die board.
Figure 2B:
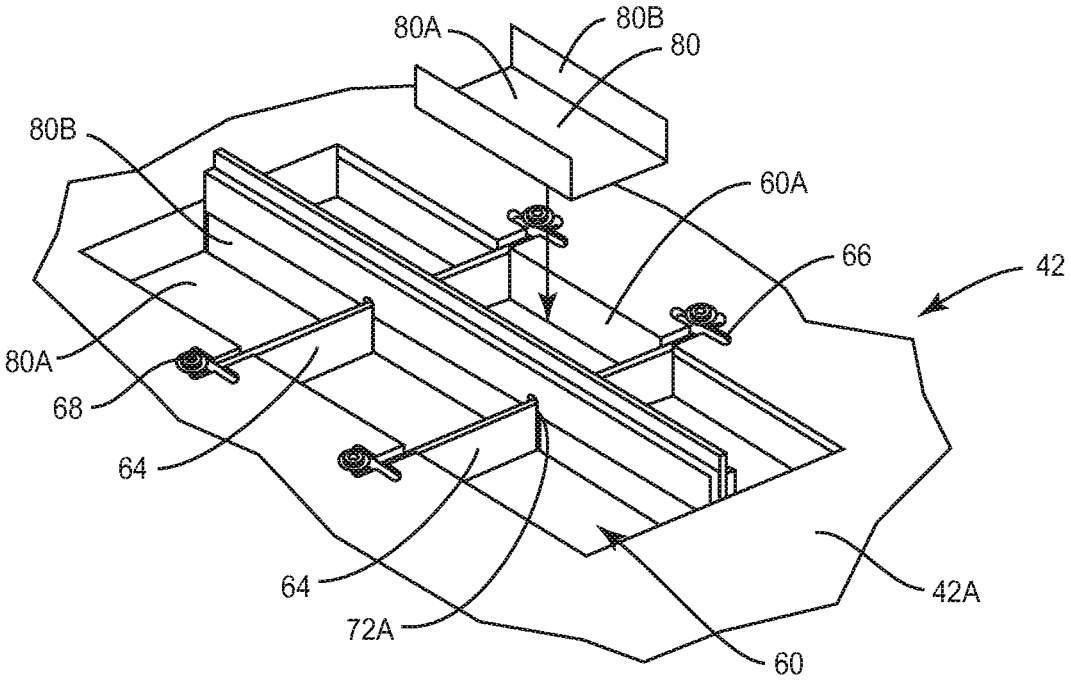
FIG. 2B is a fragmentary perspective view similar to FIG. 2A but illustrating an insert being inserted into one section of the opening.
Figure 2C:
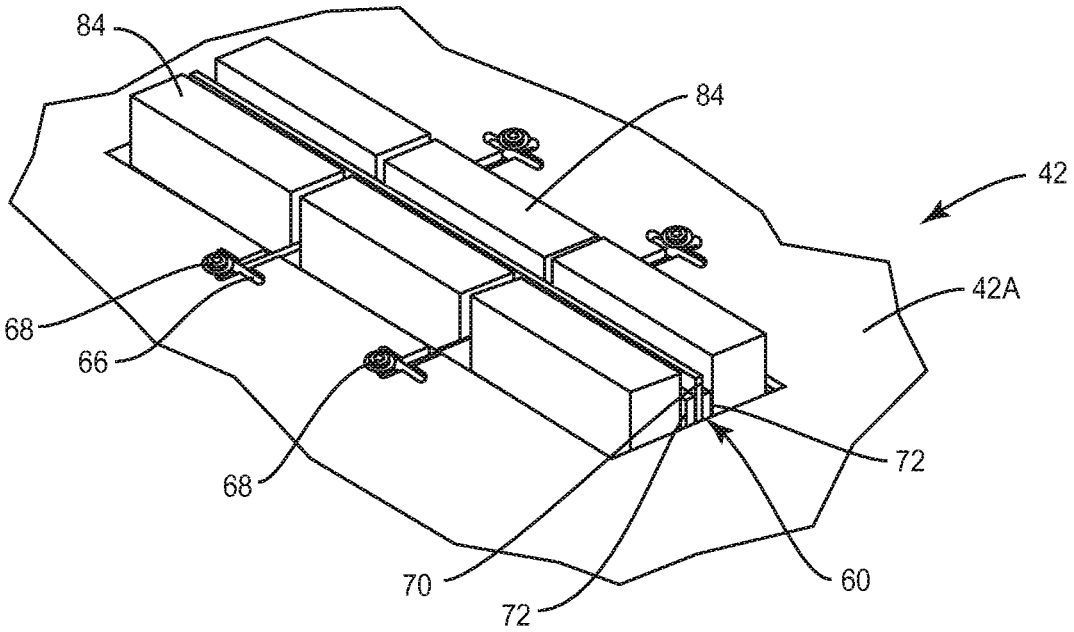
FIG. 2C is a fragmentary perspective view of the die board showing a series of product ejectors disposed in the opening in the die board.
Figure 3:
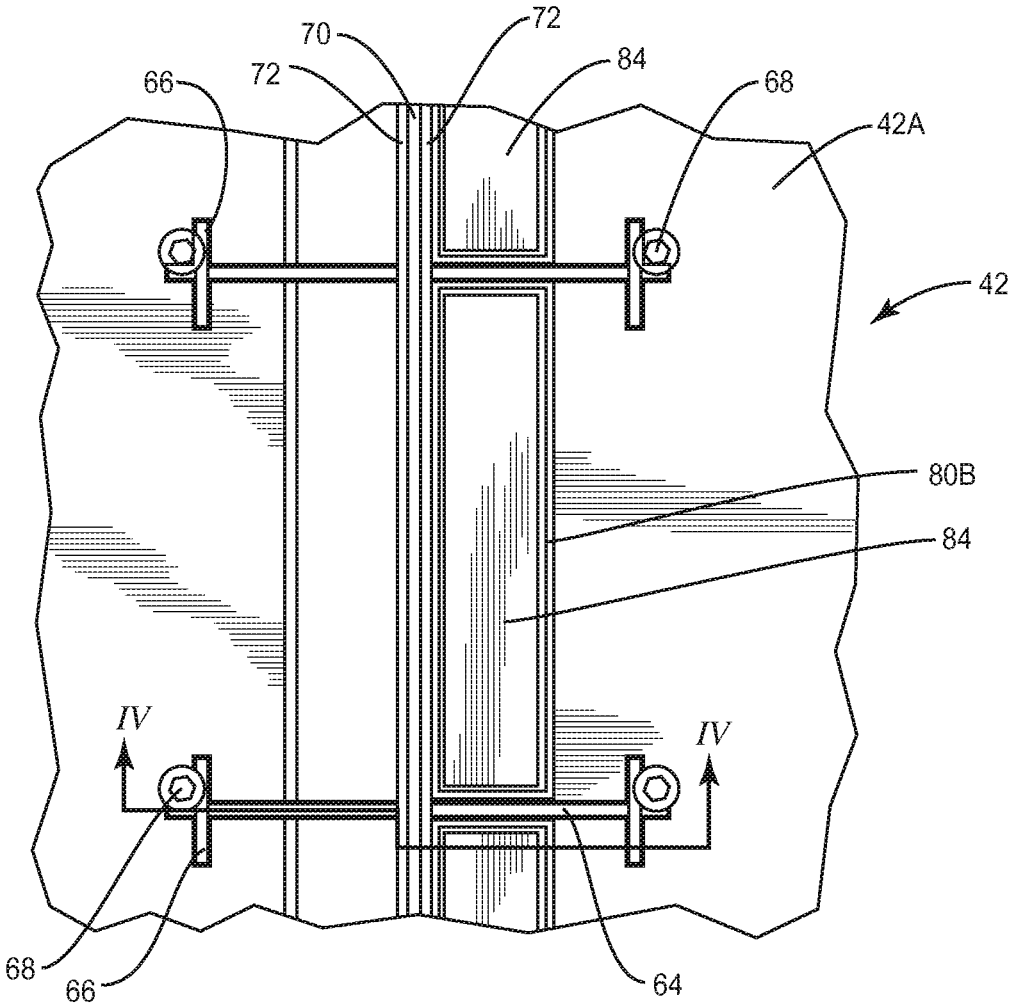
FIG. 3 is a fragmentary plan view of the die board showing a portion of the opening of the die board and a number of product ejectors disposed therein.
Figure 4:
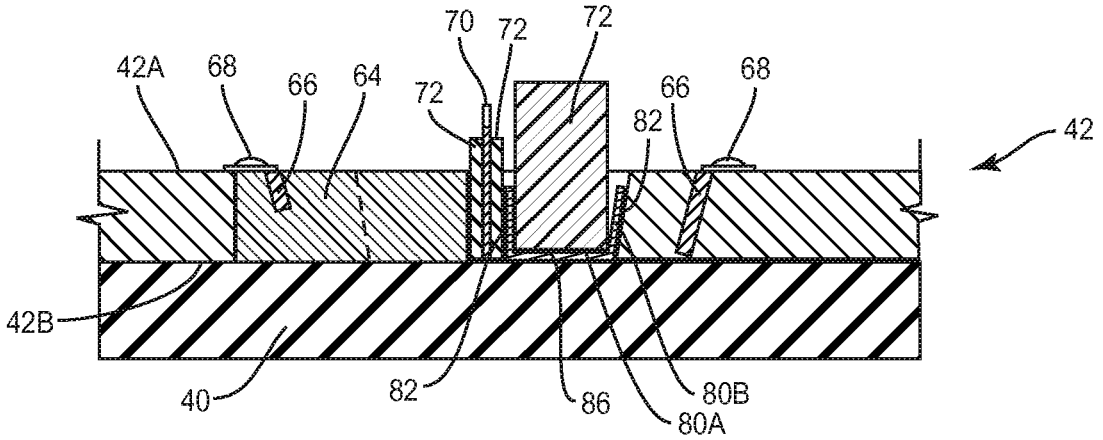
FIG. 4 is a fragmentary cross-sectional view taken through the line 4-4 of FIG. 3.

With reference to FIG. 2, the die board 42 includes an opening 60. Opening 60 can vary in size and shape. In the embodiment illustrated, opening 60 is generally rectangular. It is seen that the opening 60 extends completely through the die board 42 in the embodiment illustrated. That is, the opening extends from the outer surface 42A of the die board to the inner surface 42B which is disposed adjacent the surface of the die cylinder 40. Opening 60 includes a wall or wall structure 60A that effectively defines the opening.

Die board 42 is provided with a rule or blade support structure that spans opening 60. With reference to FIGS. 2A and 2B, for example, this support structure comprises a pair of ribs 64 that extend across the opening 60. It should be appreciated that the number of ribs 64 can vary. In the embodiment illustrated, it is contemplated that the ribs 64 are constructed of metal. Opposite end portions of the ribs 64 project into a pair of slots formed in the die board 42 adjacent the sidewall 60A of the opening 60. These slots, as seen in FIG. 2A, are open to the opening 60. Ribs 64 are securely anchored to the die board. Various ways and mechanisms can be employed to anchor the ribs 64 into the die board 42. In the embodiment illustrated, there is provided an anchor 66 that is driven into a transverse slot in the die board and held down by a screw 68. See FIGS. 3-4. Anchors 66 are effective to retain the ribs 64 in the die board 42.

Ribs 64 function to support a scoring or cutting rule in the opening 60. As seen in the drawings, there is provided a scoring or cutting rule 70 that extends over the ribs 64 at a generally 90° angle. Rule 70 in the case of the embodiments shown in the drawings includes a pair of notches 70A. See FIG. 2A. Notches 70A extend from a lower edge of the rule 70 and terminate below the outer edge. Rule 70 is installed and supported in the opening 60 by inserting the ribs 64 into the notches 70A of the rule 70. Ribs 64 and the notches 70A are dimensioned such that there is a tight frictional fit between the ribs 64 and the notches 70A. This assures that the cutting or scoring rule 70 is securely anchored within the opening 60.

To provide additional support for the scoring or cutting rule 70, there is provided a pair of supports 72 that sandwich the scoring or cutting rule. Supports 72, similar to rule 70, include notches 72A that enable the support 72 to be pressed downwardly onto the transverse ribs 64. Again, the notches 72A and the ribs 64 are dimensioned to yield a tight frictional fit between the ribs and supports. Ribs 64 prevent the cutting or scoring rule 70 and the support 72 from twisting or angling within the opening 60. The tight frictional fit that exists between the notches 70A and 72A and the ribs 64 generally serves to retain the cutting or scoring rule 70 and supports 72 in the opening 60. In addition, the cutting or scoring rule 70, supports 72, notches 70A and 72A, along with the rib 64 are dimensioned such that the lower edges of the cutting or scoring rule 70 and supports 72 engage the outer surface of the cylinder 40. See FIG. 4, for example. In some embodiments, the location of the notches can be reversed. That is, in some cases the notches may be incorporated into the ribs 64 and the scoring or cutting rule 70 and side supports 72 can be inserted into the notches in the ribs.

Opening 60 is designed to receive and hold one or more inserts 80 for receiving and supporting product ejectors 84. In one embodiment, the embodiment depicted in FIGS. 2-4, there is provided a plurality of inserts 80. In another embodiment, the embodiment shown in FIGS. 5 and 6, there is provided a single insert 80 for supporting a plurality of product ejectors 84. In any event, the insert 80 assumes the form of a tray that includes a bottom 80A and sidewalls 80B. See FIG. 2B, for example. In the case of the single insert 80 employed in the embodiment shown in FIGS. 5 and 6, the same also conforms to a general tray configuration and includes a bottom 80A and sidewalls 80B. See FIG. 6. In any event, the insert 80 can be constructed of various suitable materials, such as plastic, metal, a composite, etc.

Note in the case of the embodiment shown in FIGS. 2A-4 that there is provided six individual inserts 80. Further, note that the layout of the ribs 64, along with the scoring or cutting rule 70 and supports 72 divide the opening 60 into six sections with each section being referred to by the numeral 76 in FIG. 2A. Thus, in the case of this first embodiment, one insert 80 is designed to fit into a respective section. There are various ways to secure the insert 80 into the opening 60. For example, the insert can be press fitted into the opening or secured by appropriate fasteners. In the embodiment illustrated herein, the inserts are secured within the opening 60 by an adhesive layer 82. In the case of the first embodiment (see FIG. 4), an adhesive layer 82 secures one sidewall 80B to the wall 60B of the opening. Another adhesive layer 82 secures the opposite sidewall 80B of the insert to an outer surface of an adjacent support 72. Note that when appropriately secured within the die board 42, the bottom 80A of the insert is disposed such that the lower or outer surface of the bottom aligns with the inner surface 42B of the die board. This enables the bottom 80B to fit flush against the surface of the die cylinder 50.

Figure 5:
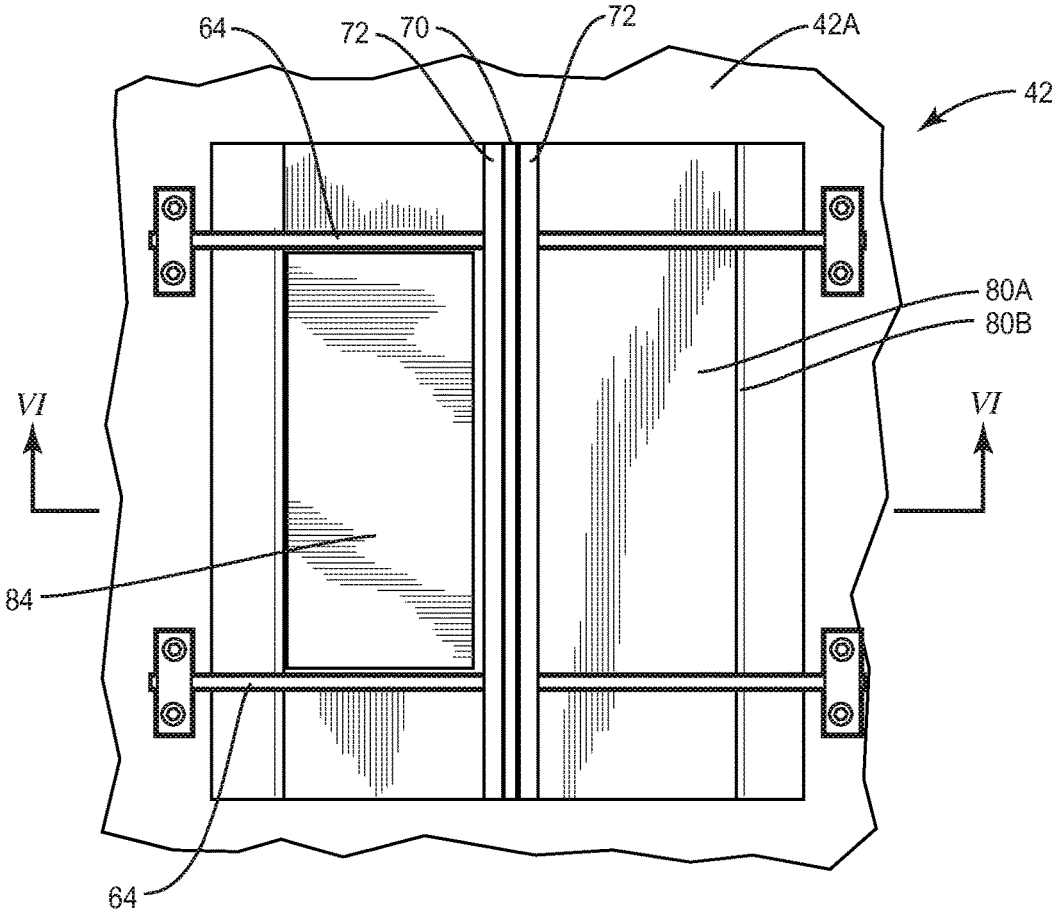
FIG. 5 is a fragmentary plan view of the opening in the die board and illustrating an alternative embodiment for the insert.
Figure 6:
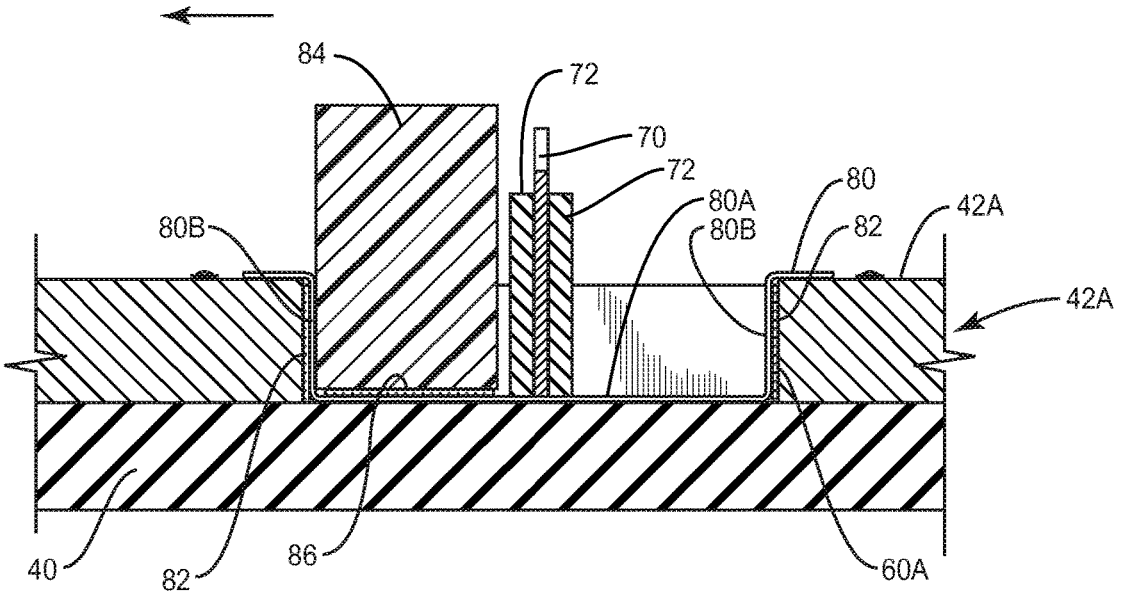
FIG. 6 is a cross-sectional view taken through the line 6-6 of FIG. 5.

Turning to FIGS. 5 and 6, as noted above, the insert 80 can be sufficiently large to fill the entire space of the opening 60.

This is illustrated in FIG. 6. Thus, in this case, the insert 80 assumes the form of a tray where the opposite sidewalls 80B are secured to the wall structure 60B by the adhesive layer 82.

Secured to the inserts 80 is one or more product ejectors 84. The product ejectors 84 are constructed of resilient and compressible material and are designed to be compressed as the die cut product passes through the nip. As the die cut product exits the nip, the product ejectors 84 expand or extend to engage the die cut product and push the die cut product from the die board. Product ejectors 84 can assume various shapes. In the embodiments illustrated herein, the product ejectors 84 assume a generally parallelepiped shape. To secure the product ejector 84 into a respective insert 80, an end portion of the product ejector is glued to the bottom 80A of the insert 80. Thus, there is a second adhesive layer 86 that secures an inner end portion of the product ejector 84 to the bottom of the insert 80. See FIGS. 4 and 6.

Figure 7:
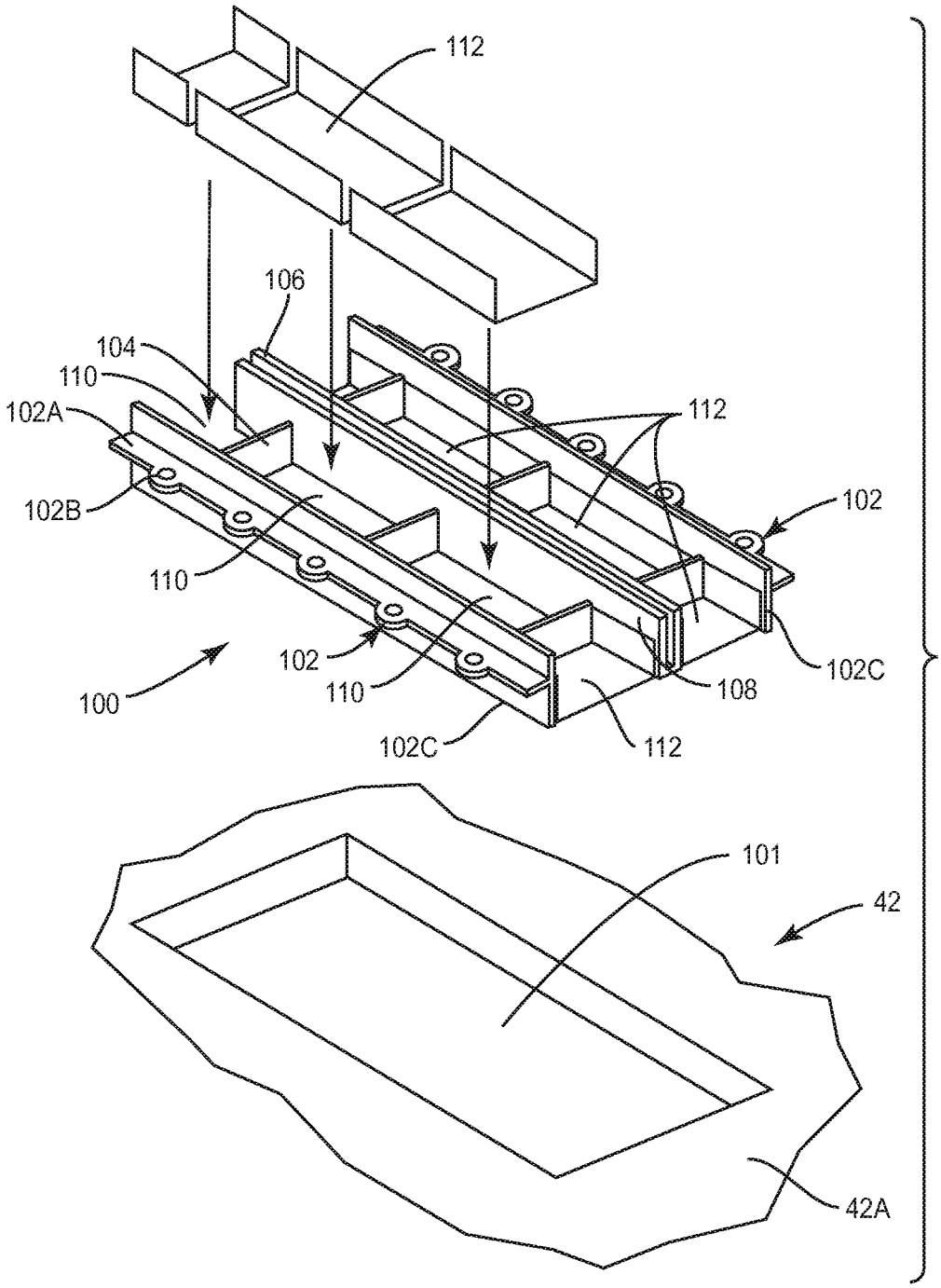
FIG. 7 is an exploded view of an alternate design for a structure for supporting one or more product ejectors on the die board.
Figure 7A:
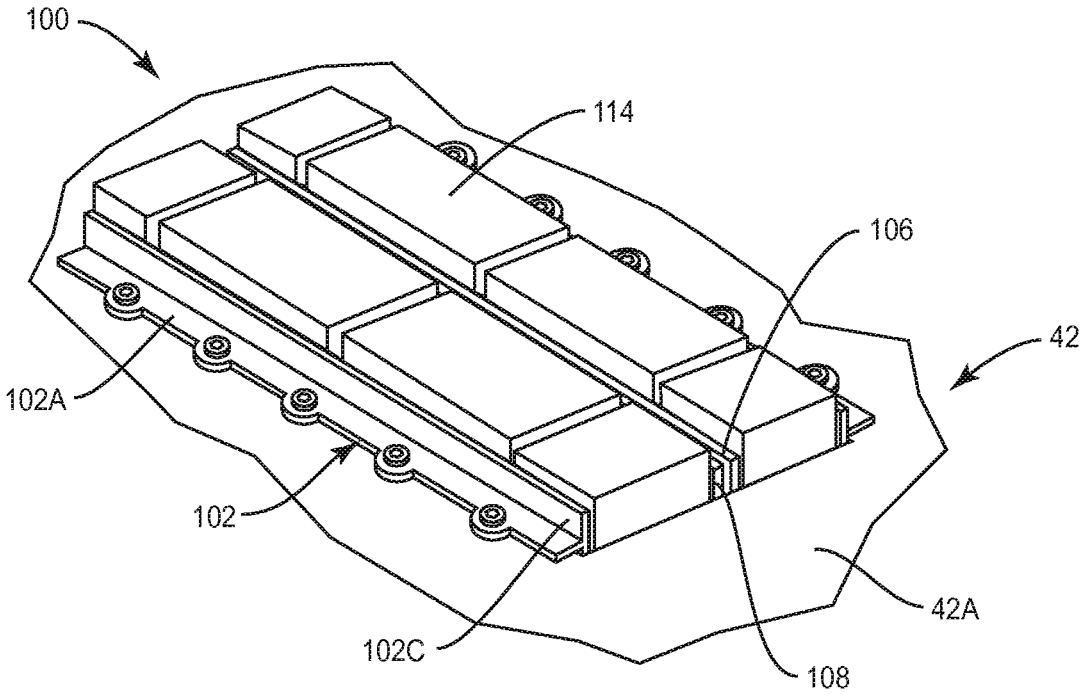
FIG. 7A is a perspective view showing the device or structure of FIG. 7 inserted and secured to the die board.

In FIGS. 7 and 7A, an alternative design is provided for supporting product ejectors on the die board. With particular reference to FIG. 7, there is provided an assembly indicated generally by the numeral 100. As will be appreciated from subsequent portions of the disclosure, this assembly 100 is designed to receive and support a plurality of product ejectors indicated by the numeral 114. See FIG. 7A. Assembly 100 can be constructed of various suitable materials, but in one embodiment the assembly is of a metal construction. Assembly 100 is designed to be inserted and secured into an opening 101. Opening 101 is of a size sufficient to accommodate the assembly 100. The size of assembly 100 and the opening 101 can vary.

Viewing assembly 100, it comprises a pair of side members, each side member being indicated generally by the numeral 102. Each side member 102 includes an outer flange 102A that is adapted to rest on the upper surface 42A of the die board. Flange 102A includes a series of screw openings 102B for accepting screws. Screws are secured downwardly through the screw openings 102B into the die board as shown in FIG. 7A. Secured to the flange 102A is an outer support or outer rail 102C. The outer supports 102C can be secured to the flanges 102A by various suitable means. In one embodiment, these components are welded. Extending between the side members 102 is one or more cross members 104. In one embodiment, the cross members 104 are secured to an inboard side of the outer supports 102C.

Extending between the side members 102 and extending in parallel relationship thereto is a cutting or scoring rule 106. In the embodiment illustrated herein, the cutting or scoring rule 106 is notched to fit downwardly over the cross members 104. Other forms of intersecting or supporting the cutting or scoring rule 106 can be employed. In addition, the cutting or scoring rule 106 is sandwiched by a pair of supports 108 that are likewise notched to fit downwardly over the cross members 104. The cutting or scoring rule 106, as well as the supports 108, can be frictionally secured to the cross members 104. In addition, the scoring or cutting rule 106 and supports 108 can be secured by other means, such as weldment, to the cross members 104.

As seen in FIG. 7, there is defined a plurality of open areas 110 in the assembly 100. In a preferred embodiment, some of the open spaces 110 are bounded by the cross members 104, side members 102, and supports 108. Some of the open areas 110 are partly bound by the opening 101 in the die board. In any event, inserts 112 are secured in the open areas 110. In the embodiment illustrated herein, the opposed sides of the inserts 112 are secured by adhesive or other suitable means to the sides of supports 108 and 102C. As with the other embodiments discussed herein, a series of product ejectors 114 are secured by adhesive or other suitable means to the bottom of inserts 112.

There are many advantages to securing the product ejector 84 in the manner described herein. First, the inserts enable a secure connection to be made directly to the insert and indirectly to the die board. In addition, controlling the pressure exerted by the product ejector is facilitated by being able to utilize relatively long product ejectors. By employing inserts in the die board and positioning the bottom of the inserts close to the inner surface of the die board enables the product ejectors to assume relatively long lengths. Typically the die board is approximately ½". By employing the inserts described herein, the product ejector can extend approximately ⅝" above the outer surface of the die board. This enables a die manufacturer to selectively choose and use ejector material that will permit pressure to be controlled and will enable the product ejectors to efficiently eject die cut product without crushing and damaging the same.

The present invention may, of course, be carried out in other ways than those specifically set forth herein without departing from essential characteristics of the invention. The present embodiments are to be considered in all respects as illustrative and not restrictive, and all changes coming within the meaning and equivalency range of the appended claims are intended to be embraced therein.

What is claimed is:

1. A rotary cutting die adapted to be mounted on a rotary die cylinder for cutting and scoring corrugated board fed into a nip disposed between the cylinder and a rotating anvil to produce a die cut product, the rotary cutting die comprising:

a curved die board configured to be mounted to the die cylinder;

an opening formed in the die board;

one or more ribs anchored to the die board and extending across the opening in the die board;

a scoring or cutting rule supported by the rib and extending across the opening for scoring or cutting corrugated board fed into the nip;

one or more inserts secured to the die board and disposed in the opening, the insert including a bottom and a sidewall; and one or more product ejectors secured to the insert and projecting therefrom, and in a no-load condition projecting past the scoring or cutting rule supported on the rib for assisting in separating the die cut product from the cutting die.

2. The rotary cutting die of claim 1 wherein the insert is a tray having the bottom and a sidewall and wherein there is a single tray secured in the opening of the die board or a plurality of trays secured in the opening in the die board.

3. The rotary cutting die of claim 1 wherein there is one or more notches formed in the rule or the rib that enables the scoring or cutting rule to be secured to the one or more the ribs.

4. The rotary cutting die of claim 3 including a pair of supports that sandwich the scoring or cutting rule and wherein the supports are engaged with and supported by the one or more ribs.

5. The rotary cutting die of claim 1 wherein the rib includes opposed end portions that project into opposed slots formed in the die board and wherein the slots are open to the opening formed in the die board.

6. The rotary cutting die of claim 1 including a plurality of inserts disposed in the opening formed in the die board and disposed adjacent the scoring or cutting rule; and at least one product ejector secured to each insert and projecting therefrom, and wherein the product ejectors are disposed adjacent the scoring or cutting rule for engaging a portion of the die cut product and assisting in separating the die cut product from the cutting die.

7. The rotary cutting die of claim 6 wherein each insert includes a tray having the bottom and the sidewall formed by two opposed sides.

8. The rotary cutting die of claim 7 wherein each insert is secured, in part at least, to the die board by an adhesive layer that secures at least one sidewall of the tray to a wall of the opening in the die board.

9. A rotary cutting die adapted to be mounted on a rotary die cylinder for cutting and scoring corrugated board fed into a nip disposed between the cylinder and a rotating anvil to produce a die cut product, the rotary cutting die comprising:

a curved die board configured to be mounted to the die cylinder;

an opening formed in the die board;

one or more ribs anchored to the die board and extending across the opening;

a scoring or cutting rule extending through the opening in the die board;

the rib being connected to the scoring or cutting rule via at least a first notch;

a pair of supports sandwiching the scoring or cutting rule and extending through the opening in the die board;

wherein the rib is connected to the supports via at least a second notch;

one or more inserts secured in the opening of the die board adjacent the supports and the scoring or cutting rule; and a product ejector seated and secured in the insert adjacent the supports and scoring or cutting rule for engaging a portion of the die cut product passing through the nip and assisting in separating the die cut product from the cutting die.

10. The rotary cutting die of claim 9 wherein there is a plurality of inserts secured within the opening in the die board and wherein each insert supports at least one product ejector.

11. The rotary cutting die of claim 9 wherein at least a portion of the insert underlies the scoring or cutting rule and the pair of supports.

12. The rotary cutting die of claim 9 wherein the opening in the die board includes a wall structure and wherein the insert includes a bottom and a sidewall, and wherein the sidewall of the insert is secured to the wall structure of the opening.

13. The rotary cutting due of claim 9 wherein the scoring or cutting rule and supports are interlocked with the one or more ribs.

14. The rotary cutting die of claim 9 wherein the first and second notches are formed in the scoring or cutting rule and supports extend from a lower edge of the scoring or cutting rule and supports and terminate short of an upper edge of the scoring or cutting rule and supports.

15. The rotary cutting die of claim 9 wherein the notches are formed in the scoring or cutting rule, supports, or the one or more ribs; and wherein the notches form a secure connection between the scoring or cutting rule, supports and the one or more ribs.

16. The rotary cutting die of claim 9 wherein the scoring or cutting rule includes an upper edge that projects above an upper edge of the one or more ribs and wherein the product ejector includes an outer surface that in a no-load condition is disposed above the upper edge of the scoring or cutting rule.

17. The rotary cutting die of claim 9 wherein the insert includes a bottom and a sidewall and is secured within the opening in the die board by an adhesive layer lying between at least a portion of the sidewall of the insert and at least a portion of a wall structure that forms the opening in the die board; and wherein there is a second adhesive layer lying between the bottom of the insert and an end portion of the product ejector.

18. The rotary cutting die of claim 9 wherein the die board includes outer and inner surfaces and wherein the insert has a height that is equal to or less than the distance between the outer and inner surfaces.

19. The rotary cutting die of claim 9 wherein the insert is in the form of a tray that includes a bottom and a sidewall, and wherein the tray is secured to a wall structure that forms the opening in the die board; and wherein the bottom of the tray supports a plurality of product ejectors and underlies the scoring or cutting rule and supports.

20. The rotary cutting die of claim 9 wherein the rib along with the supports divide the opening into a plurality of sections and wherein the opening includes a wall structure; and wherein there is provided a plurality of inserts secured in the opening with each insert disposed in a section of the opening and at least partially bound by the wall structure of the opening, the rib and one of the supports; and is at least one product ejector secured to each insert and extending adjacent one support.

21. The rotary cutting die of claim 9 wherein the rib includes opposed end portions that project into opposed slots formed in the die board and wherein the opposed slots are open to the opening formed in the die board.

* * * * *